US009568232B2

(12) United States Patent
Kim et al.

(10) Patent No.: US 9,568,232 B2
(45) Date of Patent: Feb. 14, 2017

(54) ICEMAKER AND METHOD OF CONTROLLING THE SAME

(71) Applicant: LG Electronics Inc., Seoul (KR)

(72) Inventors: Yonghyun Kim, Seoul (KR); Jimin You, Seoul (KR); Siyeon An, Seoul (KR); Sungkyoung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 463 days.

(21) Appl. No.: 14/144,684

(22) Filed: Dec. 31, 2013

(65) Prior Publication Data

US 2014/0182315 A1 Jul. 3, 2014

(30) Foreign Application Priority Data

Jan. 3, 2013 (KR) ..... 10-2013-0000510

(51) Int. Cl.
*F25C 5/08* (2006.01)
*F25C 5/00* (2006.01)
*F25C 5/18* (2006.01)

(52) U.S. Cl.
CPC ..... *F25C 5/08* (2013.01); *F25C 5/005* (2013.01); *F25C 5/187* (2013.01); *F25C 2305/022* (2013.01); *F25C 2600/04* (2013.01)

(58) Field of Classification Search
CPC ..... F25C 5/08; F25C 5/005; F25C 5/187; F25C 2305/022
See application file for complete search history.

(56) References Cited

U.S. PATENT DOCUMENTS 3,206,940 A * 9/1965 Archer ..... F25C 1/04 249/71
6,658,869 B1 * 12/2003 Thornbrough ..... F25C 1/04 62/137
6,679,073 B1 * 1/2004 Hu ..... F25C 5/08 62/135
6,904,765 B2 * 6/2005 Lee ..... F25C 5/005 62/320
8,616,018 B2 * 12/2013 Jeong ..... F25D 17/062 62/340
2004/0194480 A1 * 10/2004 Kim ..... F25C 1/04 62/135
2005/0150906 A1 * 7/2005 Ishigure ..... F25C 5/007 222/146.6
2005/0210909 A1 * 9/2005 Kim ..... F25D 17/065 62/340
2005/0257536 A1 * 11/2005 Chung ..... F25C 5/187 62/135
2008/0163639 A1 * 7/2008 Hwang ..... F25C 1/24 62/344
2008/0256962 A1 * 10/2008 Lee ..... F25C 5/187 62/137

(Continued)

*Primary Examiner* — M. Alexandra Elve
*Assistant Examiner* — Alexis Cox
(74) *Attorney, Agent, or Firm* — Fish & Richardson P.C.

(57) ABSTRACT

An icemaker includes an ice tray configured to receive water, an ejector configured to rotate to eject ice made in the ice tray, and a heater arranged to contact the ice tray and configured to facilitate separation of ice from the ice tray by selectively heating the ice tray. The icemaker also includes a case mounted to a side of the ice tray and a brushless direct current (BLDC) motor mounted in the case and configured to selectively rotate the ejector in forward and reverse directions.

17 Claims, 10 Drawing Sheets

(56) References Cited

U.S. PATENT DOCUMENTS

| | | | | |
|---|---|---|---|---|
| 2008/0295539 | A1* | 12/2008 | An | F25C 5/005 62/407 |
| 2013/0180279 | A1* | 7/2013 | Lee | F25C 5/08 62/351 |
| 2015/0276295 | A1* | 10/2015 | Barrena | F25C 1/04 62/135 |
| 2016/0084560 | A1* | 3/2016 | Jeong | F25C 5/005 62/344 |

* cited by examiner (a)

(b)

(c)

(a)

(b)

ICEMAKER AND METHOD OF CONTROLLING THE SAME

Pursuant to 35 U.S.C. §119(a), this application claims the benefit of Korean Patent Application No. 10-2013-0000510, filed on Jan. 3, 2013, which is hereby incorporated by reference as if fully set forth herein.

FIELD

The present disclosure relates to an icemaker and a method of controlling the same.

BACKGROUND

A refrigerator is an appliance used to store foods in a fresh state. The refrigerator is provided with a food storage compartment, which is maintained at a low temperature by a refrigeration cycle to keep foods fresh.

The food storage compartment may be divided into a plurality of storage compartments having different characteristics from each other to allow a user to choose a proper food-storage method in consideration of the kind, characteristic and expiration date of food. Typical examples of the storage compartments are a refrigeration compartment and a freezer compartment.

The refrigeration compartment is maintained at a temperature between about 3° C. and about 4° C. to keep foods and vegetables fresh. The freezer is maintained at a temperature below zero to keep food frozen and/or to make and store ice.

In a conventional refrigerator, a user desiring to obtain cool water stored in the refrigeration compartment needs to open the refrigeration compartment door and take out the water container placed in the refrigeration compartment.

However, a refrigerator having a water dispenser provided at the outside of the door has been developed. The dispenser allows the user to obtain water cooled by cold air in the refrigeration compartment without opening the door. Furthermore, products having a water purifying function added to the dispenser are also distributed.

In addition, when the user wants to drink water or a beverage with ice, the user needs to open the freezer compartment door and take out the ice from an ice tray provided in the freezer compartment. In this case, opening the door, taking out the ice tray and then separating ice from the ice tray may cause inconvenience.

Moreover, when the door is open, the cold air leaks out of the freezer compartment, and thereby the temperature of the freezer compartment rises. Accordingly, the compressor needs to work more, thus wasting energy.

Therefore, an automatic icemaker has been provided in refrigerators to automatically supply water, make ice, and discharge separated pieces of ice through the dispenser when necessary.

SUMMARY

In one aspect, an icemaker includes an ice tray configured to receive water and store the received water in a manner that allows the stored water to freeze into ice, an ejector configured to rotate to eject ice from the ice tray, and a heater arranged to contact the ice tray and configured to facilitate separation of ice from the ice tray by selectively heating the ice tray. The icemaker also includes a case mounted to a side of the ice tray and a brushless direct current (BLDC) motor that is mounted in the case and that is configured to selectively rotate the ejector in forward and reverse directions.

Implementations may include one or more of the following features. For example, the icemaker may include a guide member configured to guide cold air supplied to the ice tray such that cold air flow surrounds the ice tray. In this example, the guide member may be configured to guide the cold air such that a portion of the cold air supplied to an upper portion of the ice tray flows to a rear side of a rear wall of the ice tray, thereby flowing through a space between a lower surface of the ice tray and the guide member. Further, in this example, the guide member may include an upper air guide mounted over the ice tray and configured to guide the cold air supplied thereto such that the cold air is supplied to the rear side of the ice tray and a lower air guide that surrounds a lower portion of the ice tray and that is spaced a predetermined distance from the ice tray.

In some implementations, the icemaker may include an overflow prevention wall extending upward from a rear end of the ice tray. In these implementations, the icemaker may include a dropper inclined from an upper end of a front of the ice tray toward an upper portion of a rotating shaft of the ejector. Also, in these implementations, the icemaker may include an overflow prevention member horizontally oriented below the dropper and facing a rotating shaft of the ejector. The overflow prevention member may have a plurality of slits that allow protrusion fins of the ejector to pass therethrough.

In addition, the motor may be configured to rotate a rotating shaft of the ejector by a predetermined angle in forward and reverse directions. Further, the icemaker may include an ice bank arranged below the icemaker and configured to store ice made by the icemaker and a sensing bar configured to sense whether ice stored in the ice bank has reached a predetermined level.

In some examples, the icemaker may include a driving unit configured to turn the sensing bar and sense an angular position of the ejector. In these examples, the driving unit may include a first sensor unit configured to sense the angular position of the ejector and a second sensor unit configured to sense an angular position of the sensing bar.

In some implementations, the first sensor unit may include a first cam provided to a first side surface of a gear axially coupled to a rotating shaft of the ejector. The first cam may have two grooves formed at predetermined angular positions on an outer circumferential surface the first cam. In these implementations, the first sensor unit also may include a first turning member configured to turn based on a first projection located at a side portion of the first turning member contacting and sliding along the outer circumferential surface and the two grooves of the first cam and a first magnet provided to an end of the first turning member. Further, in these implementations, the first sensor unit may include a first Hall sensor configured to sense a voltage signal generated based on the first magnet being located within a threshold distance of the first Hall sensor and a first elastic member configured to pull the first turning member such that the first projection of the first turning member contacts the first cam.

In some examples, the second sensor unit may include a second cam provided to a second side surface of the gear axially coupled to the rotating shaft of the ejector. The second cam may have a groove formed at a predetermined angular position on an outer circumferential surface of the second cam. In these examples, the second sensor unit may include a second turning member configured to turn based on a side portion thereof contacting and sliding along the outer circumferential surface and the groove of the second cam and a sensing bar turning gear configured to be selectively turned by an arc-shaped large gear located at an end of the second turning member and axially coupled to a turning shaft of the sensing bar. In addition, in these examples, the second sensor unit may include a second magnet provided to a side of the sensing bar turning gear, a second Hall sensor configured to sense a voltage signal generated based on the second magnet being located within a threshold distance of the second Hall sensor, and a second elastic member configured to pull the second turning member such that a side portion of the second turning member contacts the second cam.

In some implementations, the second Hall sensor unit may include a turning force transmitting gear arranged between the arc-shaped large gear of the second turning member and the sensing bar turning gear. The turning force transmitting gear may increase a gear ratio. In these implementations, the turning force transmitting gear may include an arc-shaped small part adapted to turn based on engagement with the arc-shaped large gear, an arc-shaped large part adapted to turn based on engagement with the sensing bar turning gear, and a third elastic member arranged between and connected to the arc-shaped small part and the arc-shaped large part to allow the arc-shaped large part to turn with respect to the arc-shaped small part.

In some examples, the sensing bar may be configured to selectively turn based on the motor rotating the ejector by a predetermined angle in forward and reverse directions. In these examples, the sensing bar may be configured to sense whether ice stored in the ice bank has reached the predetermined level by turning from a lower position to an upper position and then back to the lower position based on the motor rotating the ejector by a predetermined angle in the reverse direction and then in the forward direction. The lower position may be an initial position.

In some implementations, the icemaker may include a temperature sensor unit arranged between a case of the driving unit and a sidewall of the ice tray. In these implementations, the temperature sensor unit may include a sealing plate formed of a metallic material and attached to an inner side surface of the case of the driving unit and a temperature sensor arranged inside the case and configured to measure a temperature of the sealing plate by contacting the sealing plate.

In addition, the icemaker may include a circuit board arranged in the case of the driving unit, configured to input a power on/off signal to the motor, and provided with the first Hall sensor and the second Hall sensor. The circuit board may be configured to receive a temperature signal from a temperature sensor arranged inside the case and deliver the temperature signal to a main controller. The circuit board also may be configured to deliver a command signal from the main controller to the motor.

In another aspect, a method of controlling an icemaker includes measuring an angular position of an ejector and confirming an initial position of the ejector. The method also includes supplying water to an ice tray, allowing the supplied water to freeze into ice, and rotating a sensing bar. The method further includes, based on rotation of the sensing bar, determining whether ice stored in an ice bank arranged below the icemaker has reached a predetermined level. In addition, the method includes heating the ice tray with a heater based on a determination that ice stored in the ice bank has not reached the predetermined level and rotating the ejector in a forward direction to separate ice from the ice tray.

Implementations may include one or more of the following features. For example, the method may include measuring the angular position of the ejector using a first Hall sensor configured to sense movement of a first magnet provided to an end of a first turning member adapted to turn according to turning of the ejector. In this example, the method may include determining whether ice stored in the ice bank arranged below the icemaker has reached the predetermined level using a second Hall sensor configured to sense movement of a second magnet provided to a side of a sensing bar turning gear turned by a second turning member. The second turning member may turn according to turning of the ejector.

In some implementations, the method may include starting heating before rotating the ejector to separate ice from the ice tray and periodically turning on and off the heater for a predetermined time. In these implementations, the method may include turning the heater off before the ejector returns to the initial position. Further, in these implementations, the method may include rotating the ejector twice to separate ice from the ice tray and turning the heater off before the ejector returns to the initial position by rotating twice.

It is to be understood that both the foregoing description and the following detailed description are exemplary and explanatory and are intended to provide further explanation of the subject matter claimed.

DETAILED DESCRIPTION

Figure 1:
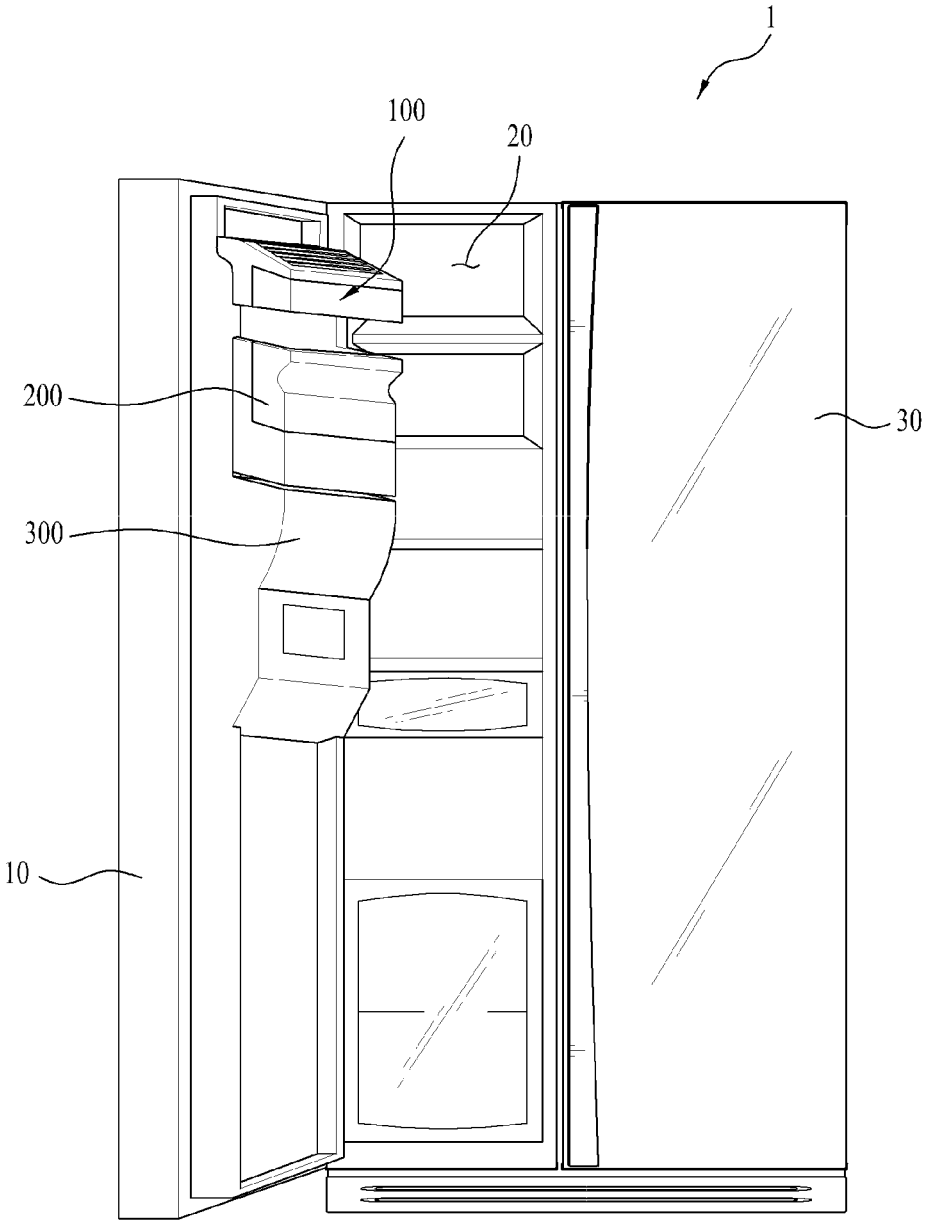
FIG. 1 is a perspective view illustrating an example refrigerator to which an example icemaker is applicable.

FIG. 1 illustrates an example refrigerator to which an example icemaker is applicable.

The refrigerator shown in FIG. 1 is a side-by-side type refrigerator having a freezer compartment 20 and a refrigeration compartment laterally arranged. However, the structure of the refrigerator contemplated in this disclosure is not limited to the side-by-side type refrigerator.

That is, the icemaker also is applicable to a bottom-freezer type refrigerator, which has a freezer compartment disposed under a refrigeration compartment, or a top mounting type refrigerator, which has a freezer compartment disposed on a refrigeration compartment.

In addition, while the icemaker is illustrated as being disposed at a freezer compartment door, it may be disposed in the freezer compartment 20, at the refrigeration compartment door 30, or in the refrigeration compartment.

In the case that the icemaker is disposed at the refrigeration compartment door 30 or in the refrigeration compartment, a separate, sealed ice-making space maintained at a temperature below zero so as to make ice may be used.

In the illustrated refrigerator, the freezer compartment 20 is arranged in the left space of the body 1, and the refrigeration compartment is arranged in the right space of the body 1. The freezer compartment 20 and the refrigeration compartment are disposed at both sides of the body 1, and opened and closed respectively by a freezer compartment door 10 and the refrigeration compartment door 30.

An ice bank 200 to store ice made by the icemaker 100 is disposed under the icemaker 100.

An ice chute 300 is disposed below the ice bank 200. The ice chute 300 forms a path along which the stored ice is selectively discharged to the outside of the refrigerator through a dispenser disposed at the front of the refrigeration compartment door 30.

Figure 2:
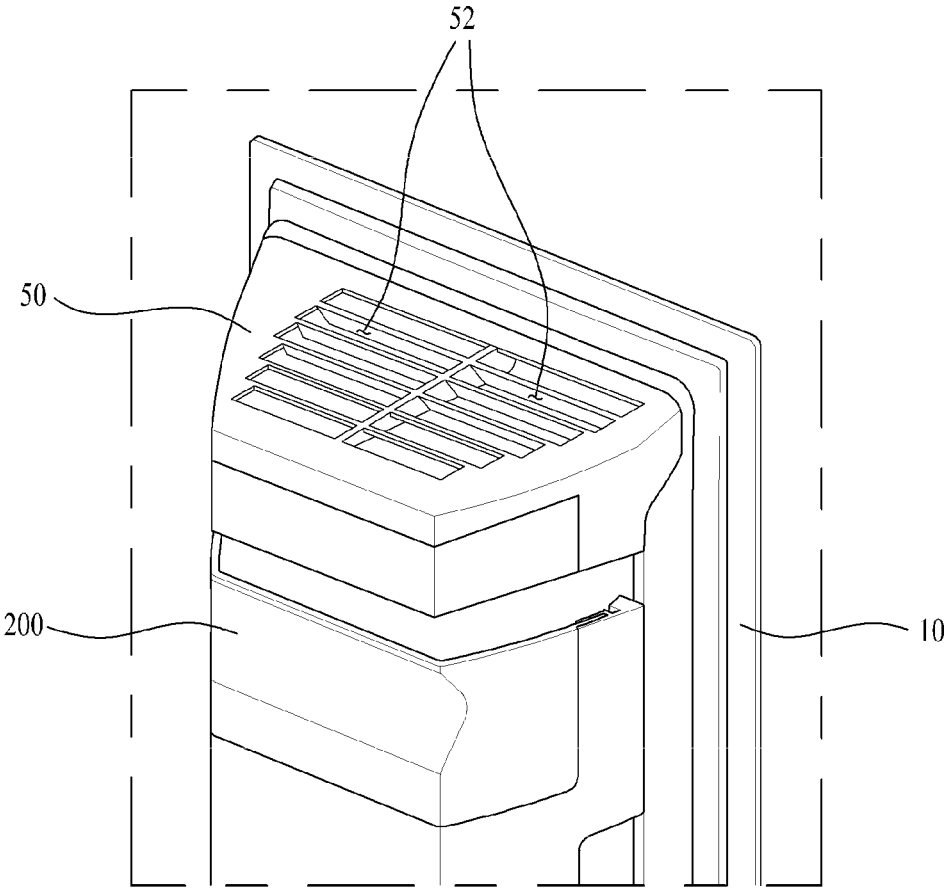
FIG. 2 is a perspective view illustrating a freezer compartment door removed from the refrigerator of FIG. 1.

FIG. 2 illustrates the freezer compartment door 10 having the icemaker 100, ice bank 200, and ice chute 300 mounted thereto. In FIG. 2, the icemaker 100 is covered by a cover 50.

The icemaker 100 may be mounted to an upper inner surface of the freezer compartment door 10 with screws.

Since the icemaker 100 is mounted to the freezer compartment door 10, cold air may be directly supplied from the freezer compartment 20 to the icemaker 100 when the freezer compartment door 10 is closed. Accordingly, a separate sealed space and a passage for supply of cold air may not be used.

The cover 50 is installed over the icemaker 100, as shown in FIG. 2, in order to prevent the icemaker 100 from being exposed when the user opens the freezer compartment door 10. The cover 50 may protect the user and/or the icemaker 100, and may reduce leakage of cold air when the door is opened.

The cover 50 does not contact an upper corner of the ice bank 200, instead being spaced a predetermined distance from the upper corner to form an opening.

In addition, a plurality of cold air inlets 52 are formed on the upper surface of the cover 50. The cold air in the freezer compartment 20 is supplied to the icemaker 100 through the cold air inlets. After cooling the icemaker 100, the circulated cold air is discharged from the freezer compartment 20 or the cover through the opening between the cover 50 and the ice bank 200.

Figure 3:
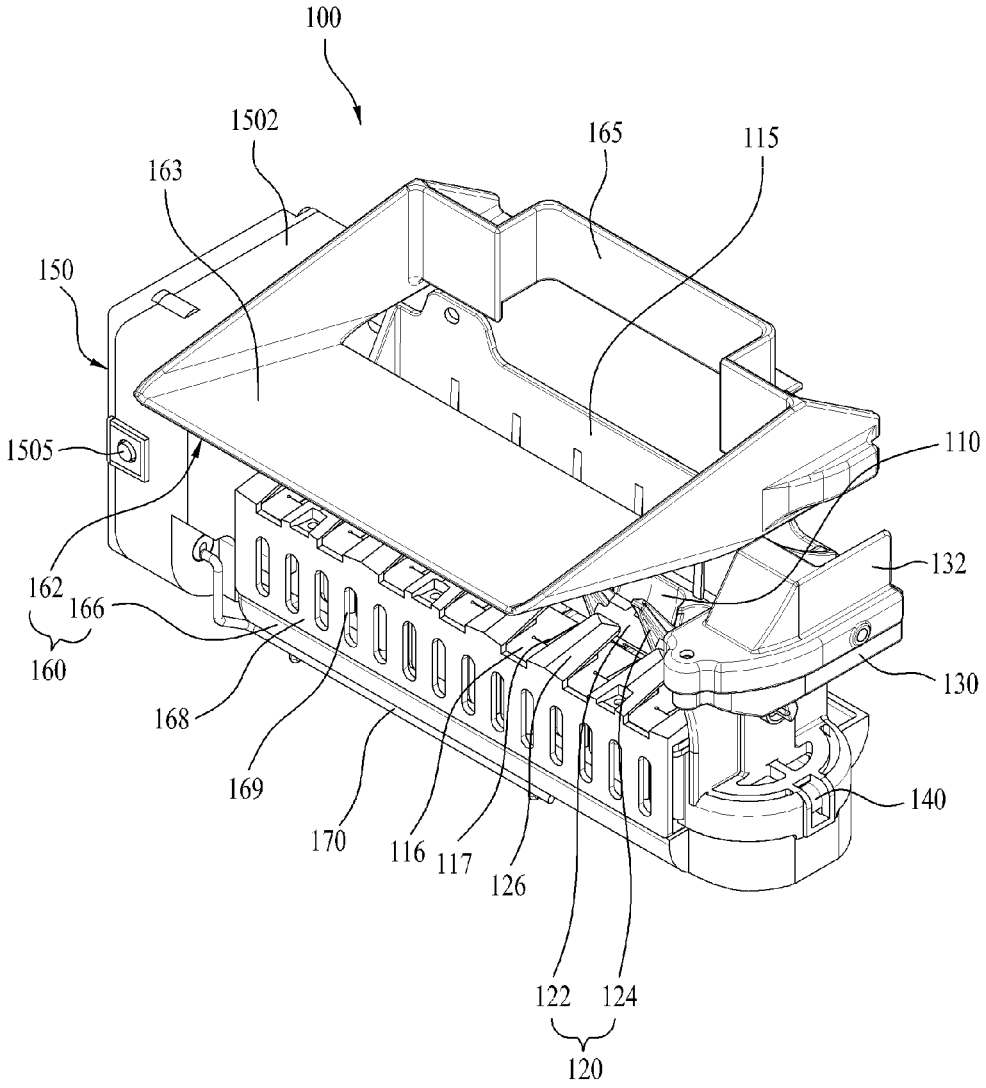
FIG. 3 is a perspective view illustrating an example icemaker.
Figure 4:
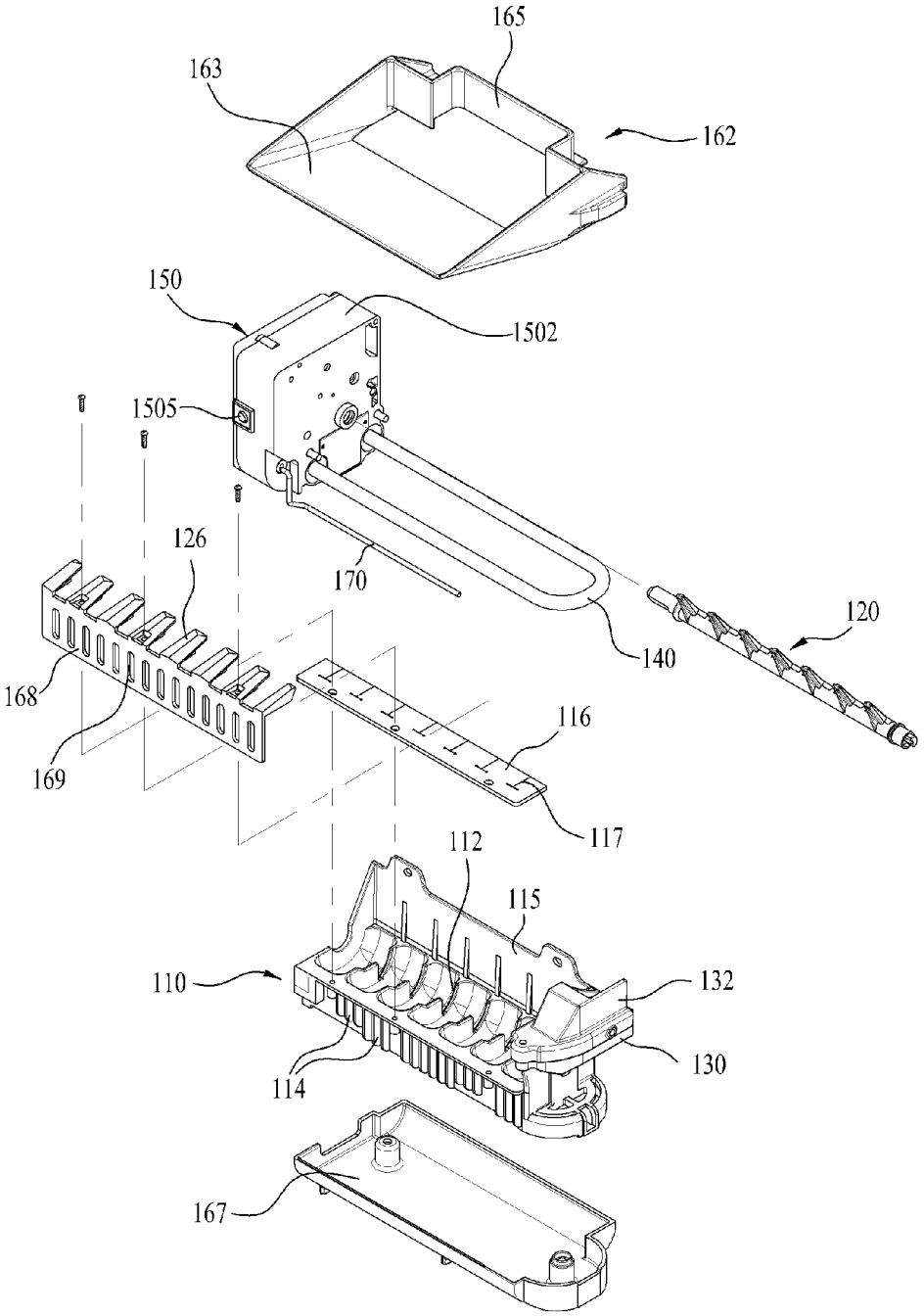
FIG. 4 is an exploded perspective view of the icemaker of FIG. 3.

FIG. 3 illustrates an external appearance of the icemaker 100, and FIG. 4 is an exploded perspective view of the icemaker 100.

The icemaker 100 includes an ice tray 110 to which water is supplied to make ice, an ejector 120 to rotate to allow the ice formed in the ice tray to be taken out, a heater 140 arranged to contact the ice tray to selectively heat the ice tray to facilitate separation of the ice, a case 1502 mounted to one side of the ice tray, and a brushless direct current motor (BLDC) 1510 (see FIG. 6) mounted to the interior of the case 1502 to selectively rotate the ejector 120 clockwise or counterclockwise.

The ice tray 110 is a structure to which water is supplied to form ice. As shown in FIG. 4, the ice tray 110 has an open upper portion and the interior thereof is formed in the shape of a semicylinder to store water and ice.

The interior of the ice tray 110 is provided with a plurality of partition ribs 112 to partition the inner space of the ice tray 110 into a plurality of ice-making spaces. The partition ribs 112 extend upward from the inner surface of the ice tray 110. Thereby, the partition ribs 112 allow a plurality of ice cubes to be simultaneously made in the ice tray 110.

A water supply unit 130 is arranged at the upper right portion of the ice tray 110 to receive water from an external water hose connected thereto and supply the same to the ice tray 110.

The water supply unit 130 has an open upper portion. In some examples, the water supply unit 130 is provided with a water supply unit cover 132 to reduce (e.g., prevent) splashing of water during supply of water.

In addition, the ice tray 110 includes an overflow prevention wall 115 extending upward from the rear upper surface of the ice tray 110. In the case that the icemaker 100 is installed at the freezer compartment door 10, the water supplied to the ice tray 110 may overflow according to movement of the door that is opened and closed by rotating. The overflow prevention wall 115 is a high wall at the back of the ice tray 110, thereby preventing the water in the ice tray 110 from overflowing from the rear side of the ice tray 110.

The ejector 120 includes a rotating shaft 122 and a plurality of protrusion fins 124. As shown FIG. 4, the rotating shaft 122, which serves as a rotating shaft of the ejector 120, is disposed at the inner upper side of the ice tray 110 in a longitudinal direction across the center of the ice tray. The inner surface of the ice tray 110 is formed in the shape of a semicylinder with the rotating shaft 122 placed at the center thereof. The protrusion fins 124 extend from the outer circumferential surface of the rotating shaft 122 in a radial direction. In some examples, the protrusion fins 124 are equally spaced from each other in the longitudinal direction of the rotating shaft 122. In these examples, each of the protrusion fins 124 is disposed in a corresponding space formed by partitioning the inner space of the ice tray 110 with the partition ribs 112.

The heater 140 is disposed under the ice tray 110. The heater 140 is an electric heater. For instance, the heater 140 is U-shaped, as shown in FIG. 4. The heater 140 heats the surface of the ice tray 110 for a short time to slightly melt the ice on the surface of the ice tray 110. Accordingly, the ice stuck to the surface of the ice tray 110 may be easily separated when the ejector 120 rotates to separate the ice.

In some implementations, a plurality of droppers 126 is provided at the upper front portion of the ice tray 110 to allow the ice separated by the ejector 120 to naturally drop to the ice bank 200 below the icemaker 100. The droppers 126 are fixed to the front corner of the ice tray 110, and extend to a position close to the rotating shaft 122. Herein, a predetermined gap is present between the droppers 126. When the rotating shaft 122 rotates, the protrusion fins 124 passes through the gap. The upper surfaces of the droppers 126 are inclined upward as they extend to the ends thereof, e.g., toward the rotating shaft 122, such that the ice on the upper surfaces may naturally slide downward to the front.

In some examples, the ice tray 110 further includes an overflow prevention member 116 arranged below the droppers 126 to prevent water from overflowing from the front of the ice tray 110. In these examples, the overflow prevention member 116 may be formed in the shape of a plate to prevent overflow of the water, and may be formed of a flexible material.

In addition, to allow the protrusion fins 124 to pass through the overflow prevention member 116 when the ejector 120 rotates, the overflow prevention member 116 may be provided with T-shaped slits 117 at positions corresponding to the protrusion fins 124. Since the overflow prevention member 116 is formed of a flexible material, the slits 117 are widened when the protrusion fins 124 pass therethrough and recover to an original shape after the protrusion fins 124 pass therethrough.

A driving unit 150 to selectively rotate the ejector 120 is arranged at one side of the ice tray 110 opposite to the water supply unit 130.

To protect the internal components of the driving unit 150, the driving unit 150 is arranged in the case 1502. A motor 1510 (see FIG. 6), which will be described in more detail later, is provided in the case 1502 to rotate the ejector 120 and to selectively apply electric power to the heater 140 through the wire connected thereto.

In addition, the motor 1510 selectively rotates an ice-fullness sensing bar 170 to sense whether the ice bank 200 disposed below the icemaker 100 is full of ice.

In some implementations, the front portion of the driving unit 150 is provided with a switch 1505 to operate the icemaker 100 for test purposes. The switch 1505 is not a switch to turn on/off the icemaker 100. When it remains pressed for a few seconds, the icemaker 100 operates in a test mode and malfunction thereof may be checked.

The guide member 160 is provided with an upper air guide 162 installed over and spaced from the ice tray 110 to guide flow of the cold air introduced through the cold air inlets 52 of the cover 50 to the rear side of the icemaker 100, and a lower air guide 166 adapted to surround the lower portion of the ice tray 110.

The upper air guide 162 is mounted to the inner surface of the freezer compartment door 10, and arranged over and spaced a predetermined distance from the ice tray 110.

In addition, the upper air guide 162 includes a slope 163 arranged at the front thereof to guide flow of cold air introduced through the cold air inlets 52 of the cover 50, which are disposed over the upper air guide 162, to the rear side of the icemaker 100. That is, while the two sidewalls and rear wall of the upper air guide 162 are vertical walls, the front portion of the upper air guide 162 is formed by the slope 163, which is inclined downwards as it extends rearward. The slope 163 guides flow of cold air introduced from the cover 50, which is disposed over the slope 163, to the rear side of the ice tray 110.

In addition, the rear wall of the upper air guide 162 includes a protrusion 165 protruding further rearward from at least the central portion of the rear wall than the overflow prevention wall 115, which defines the rear wall of the ice tray 110. A cold air flow passage is provided between the overflow prevention wall 115 and the freezer compartment door 10 below the protrusion 165. Accordingly, the upper air guide 162 guides the cold air introduced through the cold air inlets 52 of the cover 50 to both the front side and rear side of the overflow prevention wall 115.

The lower air guide 166 is arranged to surround the lower surface and front surface of the ice tray 110, and is installed to be spaced a predetermined distance from the lower surface and front surface of the ice tray 110 such that a cold air flow passage is defined between the lower air guide and the lower and front surfaces of the ice tray.

Specifically, the lower air guide 166 includes a lower-surface part 167 fixed to the lower surface of the ice tray 110 and a front-surface part 168 fixed to the front surface of the ice tray 110.

In some examples, the lower-surface part 167 is fixed to the lower surface of the ice tray 110 by a plurality of screws, and has a front-to-back length greater than that of the ice tray 110.

Accordingly, a cold air introduction passage is defined between the rear edge of the lower-surface part 167 and the rear corner of the lower surface of the ice tray 110, and another cold air introduction passage is defined between the front edge of the lower-surface part 167 and the front corner of the lower surface of the ice tray 110.

The front-surface part 168 is fixed by a plurality of screws such that it is spaced a predetermined distance from the front surface of the ice tray 110. A cold air flow passage is defined between the front-surface part 168 and the front surface of the ice tray 110. In some implementations, a plurality of cold air discharge holes 169 is horizontally arranged at the center of the front-surface part 168.

The lower end of the front-surface part 168 may be continuously connected to the front corner of the lower-surface part 167 such that a continuous cold air flow passage is formed in the lower air guide.

In addition, a plurality of fins 114 may be formed on the front surface of the ice tray 110, which is spaced apart from the front-surface part 168. The fins 114 promote transfer of heat from the ice tray 110, allowing quick cooling of the ice tray 110 when cold air passes through the cold air flow passage of the lower-surface part 167 and discharges through the cold air discharge holes 169.

While the lower-surface part 167 and the front-surface part 168 are illustrated in FIG. 4 as being formed by separate members, they may be integrated.

In addition, as shown in FIG. 4, the front-surface part 168 may be integrated with the droppers 126. In this case, the front-surface part 168 may be fixed to be spaced a predetermined distance from the front surface of the ice tray 110 by fastening the droppers 126 and the overflow prevention member 116 to the front of the upper surface of the ice tray 110 using a plurality of screws.

Figure 5:
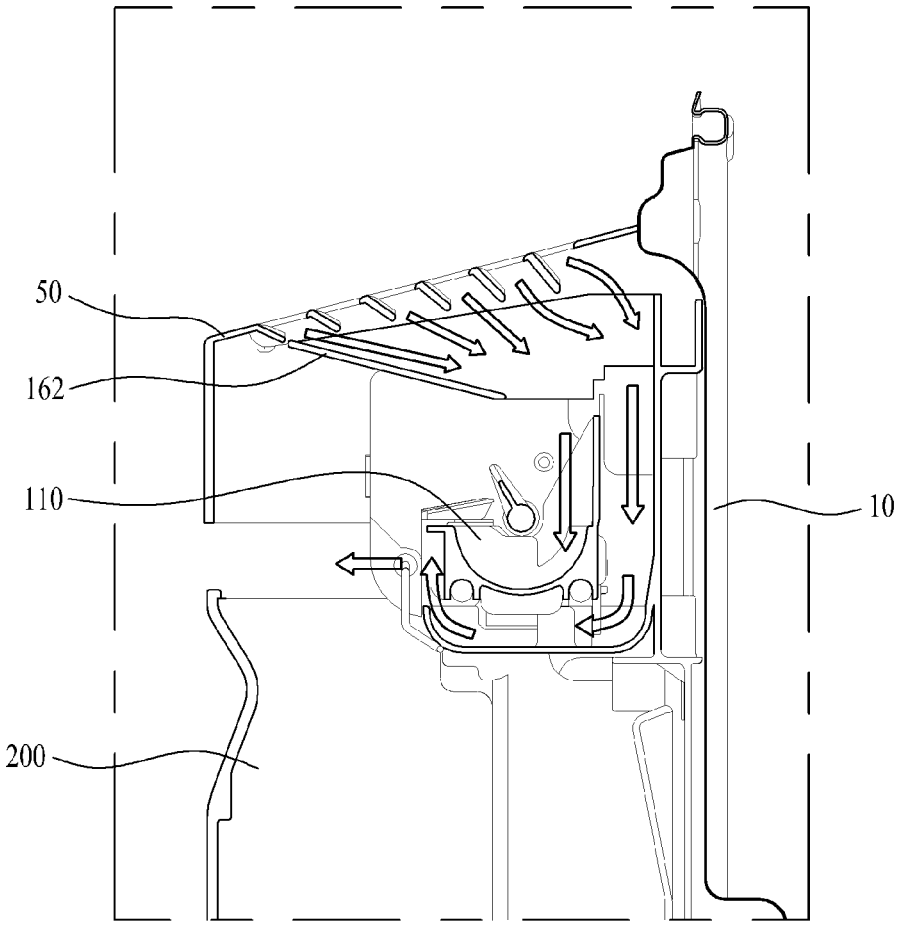
FIG. 5 is a cross-sectional view illustrating example flow of cold air supplied to an example icemaker.

Hereinafter, an example of supply of cold air to the icemaker mounted to the refrigerator door and circulation of the cold air will be described with reference to FIG. 5.

While the freezer compartment door 10 is closed, the cover 50 is positioned in the freezer compartment 20. When cold air in the freezer compartment 20 is introduced through the cold air inlets 52 formed in the cover 50, the upper air guide 162 guides the cold air to the upper rear side of the ice tray 110.

A part of the guided cold air moves downward to the front of the overflow prevention wall 115 and directly cools not only the ice tray 110 but also the water in the ice tray 110. The remaining part of the cold air moves downward through the cold air flow passage at the rear side of the overflow prevention wall 115 below the protrusion 165.

The cold air having moved down the cold air flow passage is introduced through the gap defined between the rear portion of the lower-surface part 167 and the end of the rear end of the lower surface of the ice tray 110, and flows upward through the gap defined between the front portion of the lower-surface part 167 and the corner of the front end of the lower surface of the ice tray 110.

Subsequently, the cold air moves upward along the cold air flow passage defined between the front-surface part 168 and the front surface of the ice tray 110, and is then discharged forward of the icemaker 100 through the cold air discharge holes 169 formed in the front-surface part 168.

Finally, the cold air discharged through the discharge holes 169 is discharged to the opposite side of the door, namely, toward the freezer compartment 20 through the opening defined between the lower end of the cover 50 and the upper end of the ice bank 200, while the door is closed.

Next, an example of the structure of the driving unit will be described with reference to FIGS. 6 to 10.

The driving unit 150 includes a case 1502 mounted to a side of the ice tray and a motor 1510 mounted in the case to selectively rotate the ejector.

The case 1502 has the shape of a rectangular parallelepiped, and is provided therein with a mount portion for various gears and cams. In some examples, one side surface of the case is provided with an opening, at which a cover is coupled to the surface.

The motor 1510 rotates the rotating shaft 122 of the ejector 120 by a predetermined angle clockwise or counterclockwise. To this end, the motor 1510 is may be a motor rotatable clockwise and counterclockwise, particularly, a BLDC motor.

In the case that the motor 1510 is rotatable clockwise and counterclockwise, a complex connection structure of gears and cams for clockwise and counterclockwise rotation of the ejector 120 may be eliminated and the ice-fullness sensing bar 170 may be rotated by a predetermined angle clockwise and counterclockwise.

In addition, since the volume of the BLDC motor can be smaller than that of an alternating current motor, the BLDC motor allows a relatively large ice tray 110 to be placed in a limited space.

The rotational speed of the motor 1510 is reduced through a plurality of reduction gears 1511, 1512, 1513 and 1514, and then rotates an ejector rotating gear 1520, which is axially coupled to the rotating shaft 122 of the ejector 120 to rotate the ejector. Since the motor 1510 is rotatable clockwise and counterclockwise, the ejector rotates in a first direction when the motor rotates in the first direction, and rotates in a second direction when the motor rotates in the second direction.

While FIGS. 6 to 10 show four reduction gears 1511, 1512, 1513 and 1514, the number and reduction ratio of the reduction gears may be properly changed according to the specifications of the motor 1510.

The motor 1510 is connected to a circuit board 1580 arranged at one side of the interior of the case 1502 such that electric power is supplied to the motor 1510.

In addition, the driving unit 150 further includes a first Hall sensor unit to sense an angular position of the ejector and a second Hall sensor unit to sense an angular position of the ice-fullness sensing bar.

Figure 9:
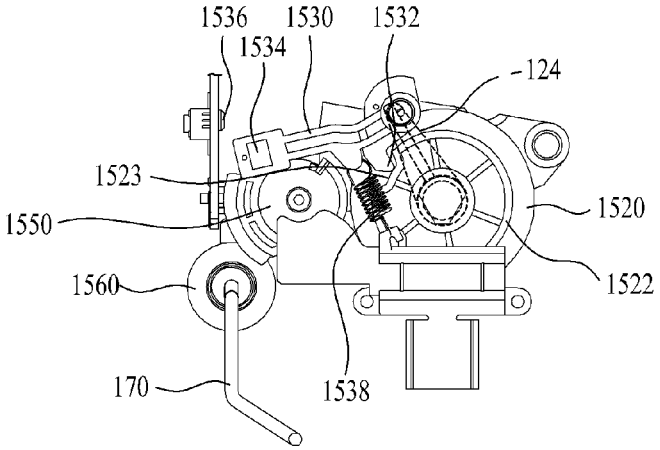
FIG. 9 is a right-side view illustrating example operation of the first turning member shown in FIG. 7.
Figure 9:
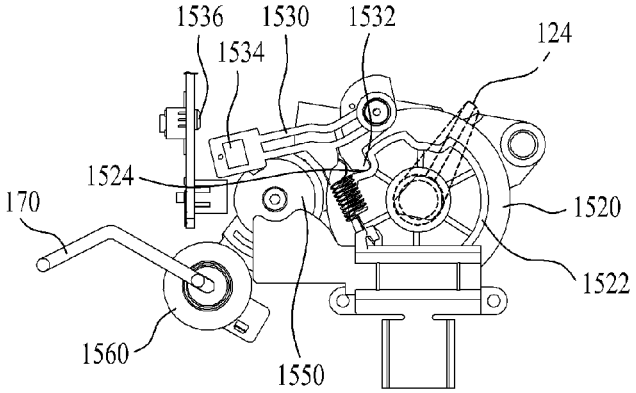
Figure 9:
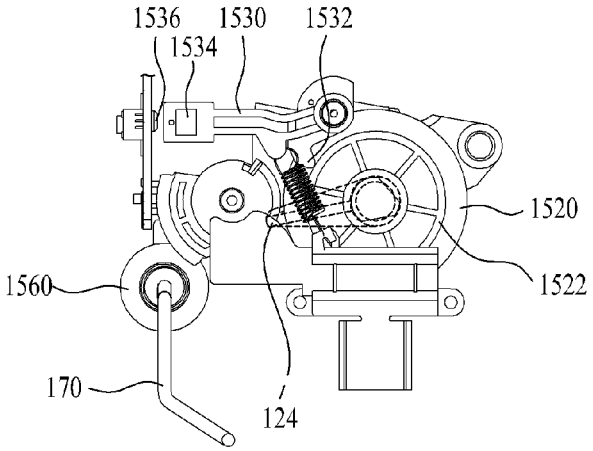

Provided at one side surface of the ejector rotating gear 1520 is a first cam 1522 that has the shape of a disk and that has two grooves at predetermined angular positions on the outer circumferential surface of the first cam 1522. The two grooves include, as shown in FIGS. 9(*a*) to 9(*c*), a first groove 1523 to define the initial angular position of the ejector 120 and a second groove 1524 spaced a predetermined angle from the first groove 1523. The first groove 1523 may have the same depth as the second groove 1524, but a wider angle than the second groove 1524.

Provided at one side of the ejector rotating gear 1520 is a first turning member 1530 which is in contact and engaged with the first cam 1522. A first projection 1532 is formed at one side of the first turning member 1530. Thereby, the first turning member 1530 rotates as the first projection 1532 slides along the outer circumferential surface of the first cam 1522 and the two grooves.

An end of the first turning member 1530 is provided with a magnet 1534, and a first Hall sensor 1536 is installed at a position adjacent to the magnet 1534 to measure a voltage signal generated when the magnet 1534 approaches.

The first Hall sensor 1536 is a sensor that utilizes the Hall effect of generating voltage when the magnet 1534 approaches. Since electrical current flows through the sensor, the sensor may be installed at the circuit board 1580.

Since the first turning member 1530 needs to be kept in contact with the first cam 1522, a first elastic member 1538 is provided between one side of the first turning member 1530 and a lower fixing position in the case 1502 to pull down the first turning member 1530 such that the first turning member 1530 contacts the first cam 1522.

Figure 7:
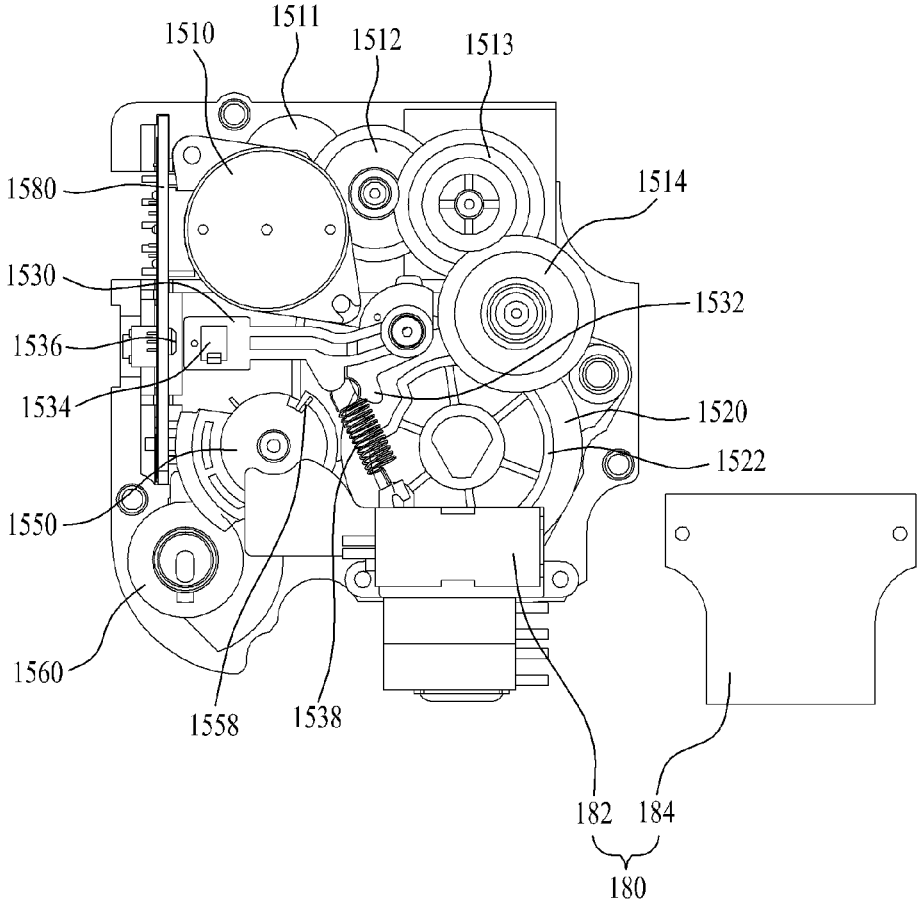
FIG. 7 is a right-side view of FIG. 6.

As shown in FIG. 7, the first elastic member 1538 may be caught by a projection protruding downward from the central portion of the first turning member 1530, and a ring protruding from a fixing portion of a temperature sensor 182, which will be described in more detail later.

The first Hall sensor unit including the first turning member 1530 and the first Hall sensor 1536 may sense the rotational angle of the ejector 120 by sensing a position signal generated when the first projection 1532 is inserted into the first groove 1523 and second groove 1524 of the first cam 1522 according to rotation of the ejector rotating gear 1520.

Further, a temperature sensor unit 180 is provided in the case 1502 of the driving unit 150 to contact the side surface of the ice tray 110 coupled to the side surface of the case 1502. The temperature sensor unit 180 includes a temperature sensor 182 to measure a voltage signal according to the temperature of the ice tray 110, and a conductive plate 184 formed of a metallic material and interposed between the temperature sensor unit and the ice tray 110 to prevent infiltration of water.

The temperature sensor 182 may be embedded in waterproof elastic rubber and fixed to one side of the case 1502. The temperature sensor 182 serves to measure the temperature of the ice tray 110, and thus an opening exposing the temperature sensor 182 is formed in one side surface of the case 1502, which is formed of plastic.

The temperature sensor 182 does not directly contact the ice tray 110, but indirectly contacts the ice tray 110 through the conductive plate 184. Accordingly, the conductive plate 184 may not only prevent infiltration of water by closing the opening formed in the side surface of the case 1502, but also may allow heat to be conductively transferred from the ice tray 110 to the temperature sensor 182 such that the temperature of the ice tray 110 is measured. The conductive plate 184 may be a metallic plate having high thermal conductivity, and may be fixed to a side surface of the case 1502 by performing insert molding with a stainless steel plate.

Figure 6:
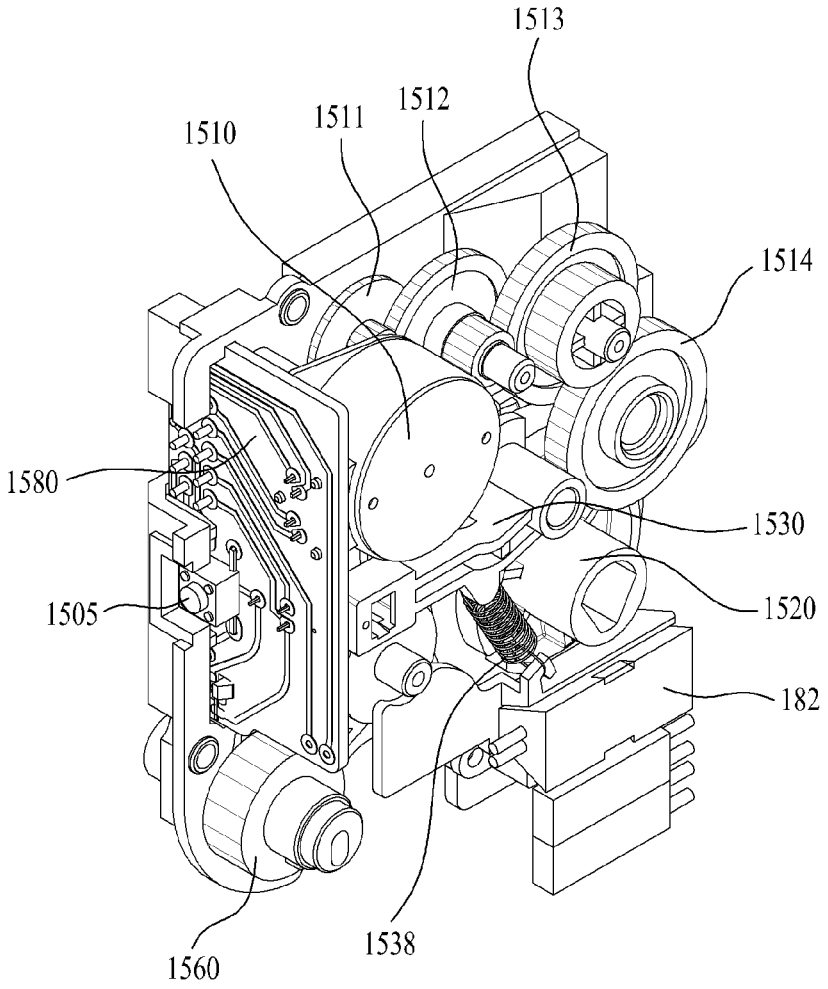
FIG. 6 is a perspective view illustrating an interior of the example driving unit shown in FIG. 4.

In addition, the temperature sensor 182 measures change in voltage according to change in temperature, and is thus connected to the circuit board 1580 through a wire. FIGS. 6 and 7 show only a portion of the wire connected to the left side of the temperature sensor 182.

Figure 8:
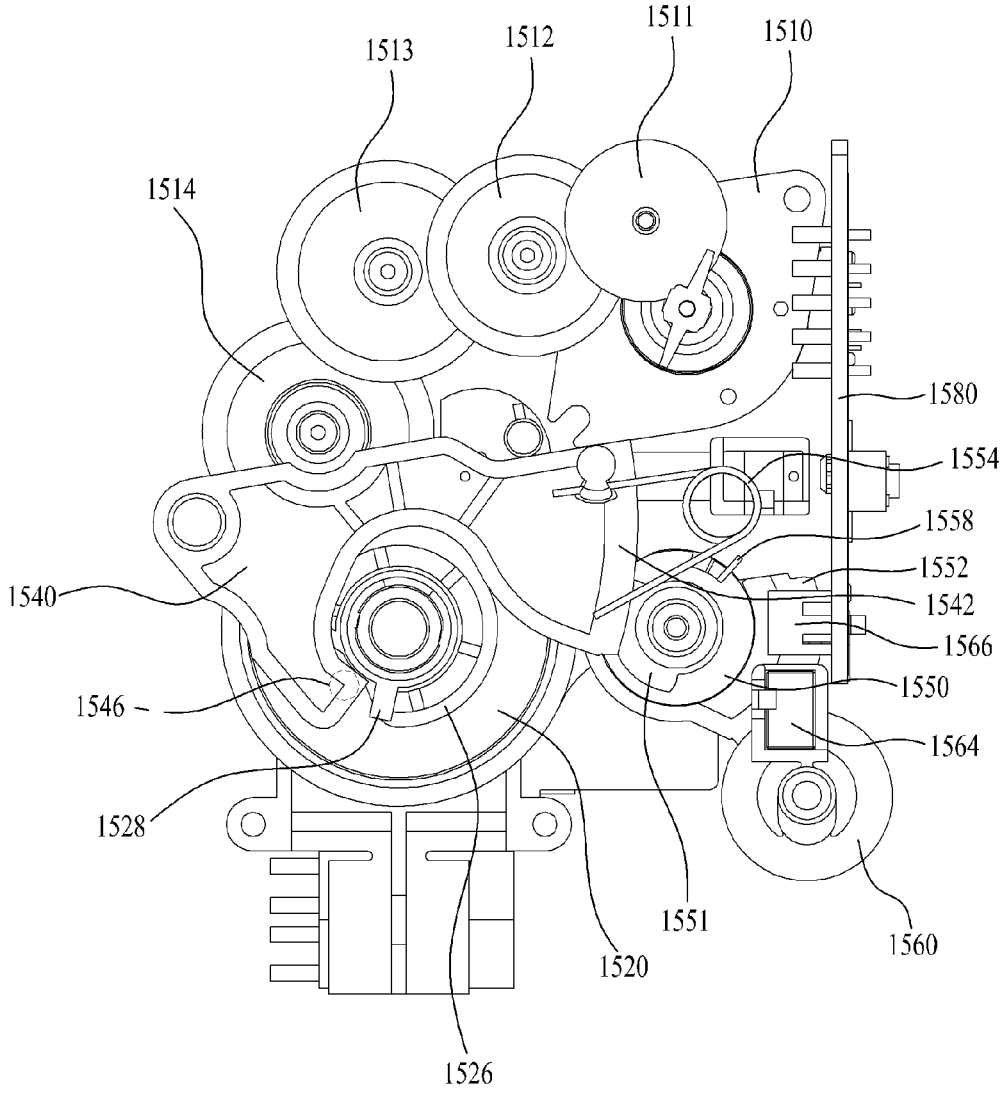
FIG. 8 is a left-side view of FIG. 6.

Next, FIG. 8 shows a side view of the interior of the driving unit as seen from the left side of the driving unit.

A disc-shaped second cam 1526 having a diameter equal to about half the diameter of the ejector rotating gear 1520 is provided on the left side surface of the ejector rotating gear 1520. A groove 1527 (see FIGS. 10(*a*) and 10(*b*)) is formed at one side of the second cam 1526.

A second turning member 1540 adapted to turn through interaction with the second cam 1526 is mounted to a position near the second cam 1526. The second turning member 1540 turns at the front of the second cam 1526 and surrounds the center of the ejector rotating gear 1520. A second projection 1546 is vertically arranged on the surface of one end of the second turning member 1540, namely, the surface proximal to the second cam 1526. Thereby, the side surface of the second projection contacts the outer circumferential surface of the second cam 1526.

The other end of the ejector rotating gear 1520 is turned upward by elastic force from a second elastic member 1554. The second elastic member 1554 has the shape of a torsion spring having both ends thereof stretching out a distance. Compared to the first elastic member 1538, which produces elastic force in a longitudinal direction, the second elastic member 1554 produces elastic force in a radial direction to widen a space between the ends. One side of the second elastic member 1554 is caught by a hook protruding from the side surface of the other end of the ejector rotating gear 1520, and the other side thereof is held and fixed by one surface of the case.

A stoppage projection 1528 is formed on the rotating shaft of the ejector rotating gear 1520 and on a side surface of the front of the second cam 1526 in a radial direction. The stoppage projection 1528 is installed to turn within a predetermined angular range with respect to the rotating shaft of the ejector rotating gear 1520. Accordingly, when the ejector rotating gear 1520 rotates counterclockwise, the stoppage projection 1528 turns by a predetermined angle in the same direction, thereby allowing the second projection 1546 of the second turning member 1540 to enter the groove 1527 of the second cam 1526. When the ejector rotating gear 1520 rotates clockwise, the stoppage projection 1528 turns by a predetermined angle in the same direction and enters the side surface of one end of the second turning member 1540 having the second projection 1546, by which the stoppage projection 1528 is caught. Accordingly, the second projection 1546 is prevented from entering the groove 1527 of the second cam 1526. Thereby, the second turning member 1540 is prevented from turning.

In this regard, the stoppage projection 1528 allows the second turning member 1540 to turn upward only when the ejector rotating gear 1520 rotates counterclockwise.

An arc-shaped large gear part 1542 is located at the other end of the ejector rotating gear 1520 and connected to a turning force transmitting gear 1550. The arc-shaped large gear part 1542 has the shape of a circular arc since it turns within a predetermined angular range.

The turning force transmitting gear 1550 includes an arc-shaped small gear part 1551 turning in engagement with the arc-shaped large gear part 1542 and an arc-shaped large gear part 1552 engaged with the ejector rotating gear 1520 to turn the ejector rotating gear 1520.

The rotational angle of the turning force transmitting gear 1550 is greater than that of the arc-shaped large gear part 1542, but does not exceed 180 degrees. Accordingly, the small gear part 1551 and the large gear part 1552 may be arranged in a circular arc shape. The arc-shaped large gear part 1552 turns an ice-fullness sensing bar turning gear 1560, to which one end of the ice-fullness sensing bar 170 is axially coupled.

In addition, a third elastic member 1558 allowing the arc-shaped large gear part 1552 to turn with respect to the arc-shaped small gear part 1551 is provided between the arc-shaped small gear part 1551 and the arc-shaped large gear part 1552. The third elastic member 1558 is a torsion spring fitted into the turning shaft of the turning force transmitting gear 1550. One end of the third elastic member 1558 is supported by the arc-shaped large gear part 1552, and the other end of the third elastic member 1558 is supported by the arc-shaped small gear part 1551. Thereby, the third elastic member 1558 provides elastic force in a direction of widening a space between the ends. Since the third elastic member 1558 is adapted to turn a predetermined angle, damage to the gears may be prevented even when downward movement of the ice-fullness sensing bar 170 to sense whether the ice bank 200 is full of ice is stopped by the ice.

A magnet 1564 is fixed to a side of the ice-fullness sensing bar turning gear 1560, and a second Hall sensor 1566 may be installed at a side surface of the lower portion of the circuit board 1580. The second Hall sensor 1566 may be arranged to protrude with respect to the position of the magnet 1564.

When the ice-fullness sensing bar turning gear 1560 turns, the magnet 1564 turns as well. When the ice-fullness sensing bar 170 turns to the lowest position, the magnet 1564 is positioned close to the second Hall sensor 1566, and the second Hall sensor 1566 senses a signal at this position of the magnet 1564. That is, when it is sensed that the ice-fullness sensing bar 170 has reached the lowest position by turning upward then downward, the second Hall sensor 1566 may sense that the ice bank 200 is not yet full of ice.

Also, the circuit board 1580 is provided in the case 1502 of the driving unit 150 and connected to the switch 1505, part of which protrudes from the case 1502. In addition, the circuit board 1580 is adjacent and connected to the motor 1510. The first Hall sensor 1536 and the second Hall sensor 1566 are installed at the circuit board 1580. The circuit board 1580 is also connected to the temperature sensor 182, which is provided inside the case 1502, through a wire.

Thereby, the circuit board 1580 executes the test mode according to an operation signal from the switch 1505, and rotates the motor 1510 in the forward direction or reverse direction. The circuit board 1580 delivers the sensing signals from the first Hall sensor 1536, the second Hall sensor 1566, and the temperature sensor 182 to a main controller provided to the body of the refrigerator. In addition, the circuit board 1580 receives a signal for an operational command from the main controller to operate the motor 1510.

In some implementations, the circuit board 1580 does not include a controller to control the icemaker 100. Accordingly, the circuit board may be designed to have a very small size. The circuit board 1580 delivers sensing signals and command signals to the main controller, thereby allowing the main controller to control the icemaker 100.

Next, example operation of the first Hall sensor unit and the second Hall sensor unit will be described with reference to FIGS. 9 and 10.

FIGS. 9(*a*) to 9(*c*), which show some of the internal components of the driving unit, is a side view illustrating operation of the first Hall sensor unit seen from the right side, i.e., from the side at which the ejector is provided.

FIG. 9(*a*) shows the protrusion fins 124 of the ejector 120 located at an initial position (hereinafter, referred to as a "first position"). In this position, the first projection 1532 of the first turning member 1530 remains inserted into the first groove 1523 of the first cam 1522. Accordingly, the first turning member 1530 remains turned downward by being pulled by the first elastic member 1538. Thereby, the first Hall sensor 1536 is spaced apart from the magnet 1534 and thus prevented from sensing a signal.

Next, FIG. 9(*b*) shows the protrusion fins 124 of the ejector 120 turned toward a right upper side to a position (hereinafter, referred to as a "second position") by reversely rotating the motor by a predetermined angle to sense fullness of ice. At this time, the first projection 1532 of the first turning member 1530 is inserted into the second groove 1524 of the first cam 1522, and accordingly the first turning member 1530 is pulled downward by the first elastic member 1538. Thereby, the first Hall sensor 1536 is spaced apart from the magnet 1534, and thus cannot sense a signal.

When the first projection 1532 passes the outer circumferential surface of the first cam 1522 between the first groove 1523 and the second groove 1524, it is pushed upward by the outer circumferential surface of the first cam 1522, and thus the first turning member 1530 is turned upward, as shown in FIG. 9(*c*), despite the pulling force from the first elastic member 1538. At this time, the first Hall sensor 1536 is spaced apart from the magnet 1534 and thus a signal is sensed.

That is, the first Hall sensor 1536 continuously senses signals while the first projection 1532 passes the outer circumferential surface of the first cam 1522 other than the first groove 1523 and the second groove 1524. When the first projection 1532 enters the first groove 1523 or second groove 1524 of the first cam 1522, sensing of signals is interrupted. Thereby, the angular position of the ejector 120 may be determined.

When the ejector rotating gear 1520 moves to a position shown in FIG. 9(*b*), the ice-fullness sensing bar 170 is turned and raised upward according to operation of the second turning member 1540, which will be described in more detail later.

During operation of sensing fullness of ice, the ejector rotating gear 1520 rotates from the initial position of FIG. 9(*a*) to the position of FIG. 9(*b*) and then back to the position of FIG. 9(*a*). To achieve such rotation, the motor 1510 rotates the ejector rotating gear 1520 by a predetermined angle in a reverse direction and then in the forward direction. Thereby, the ice-fullness sensing bar 170 turns from a lower position shown in FIG. 9(*a*) to an upper position shown in FIG. 9(*b*) and then back to the lower position. At this time, the second Hall sensor 1566 senses whether the ice-fullness sensing bar 170 is lowered to the lowest position, which will be described in more detail later.

When the ice-fullness sensing bar 170 is lowered to the lowest position as shown in FIG. 9(*a*), it may be determined that the ice bank 200 is not full of ice. If the ice-fullness sensing bar 170 moving downward is interrupted by ice and thus fails to reach the lowest position, it may be determined that the ice bank 200 is full of ice.

When it is determined in sensing fullness of ice that the ice bank 200 is not full of ice, the heater 140 is first heated, and then the ejector 120 is rotated 360 degrees in the forward direction. Then, ice is separated from the ice tray 110 and drops into the ice bank 200. FIG. 9(*c*) shows the ejector 120 rotating to separate the ice. In the illustrated state, the magnet 1534 remains close to the first Hall sensor 1536. Accordingly, the state shown in FIG. 9(*c*) is maintained and the first Hall sensor 1536 continues to sense this state until the first turning member 1530 turns to be lowered.

When the ejector 120 reaches the second position of FIG. 9(*b*) before returning to the initial position (the first position), the heater 140 is turned off. The heater 140 may consume a relatively large amount of power as an electric heater. Power consumption may be reduced by reducing the time for which the heater operates.

Figure 10:
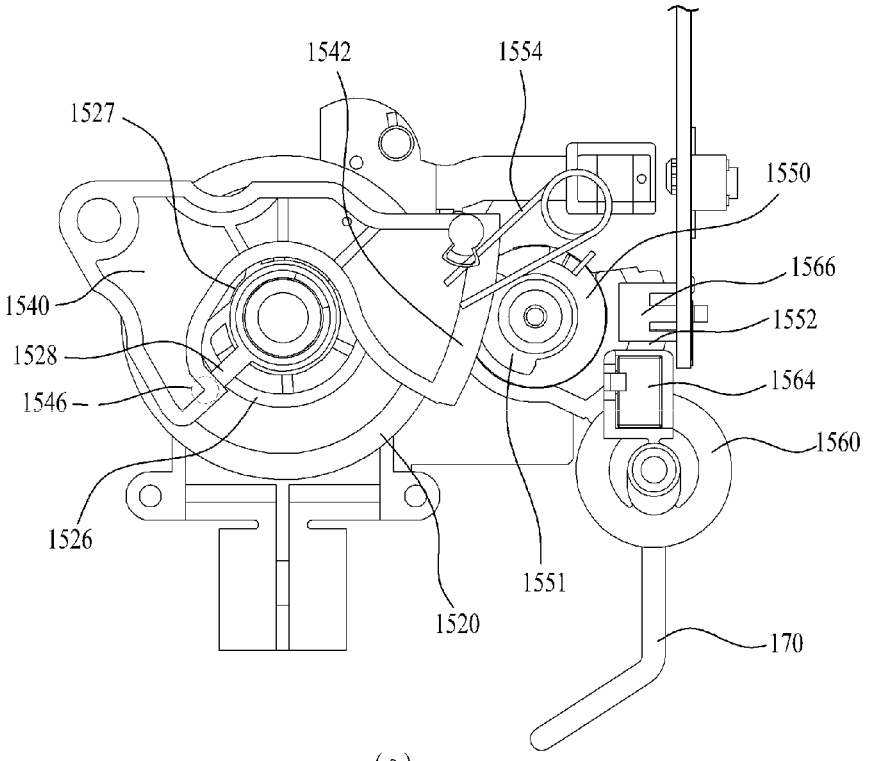
FIG. 10 is a left-side view illustrating example operation of the first turning member shown in FIG. 8.
Figure 10:
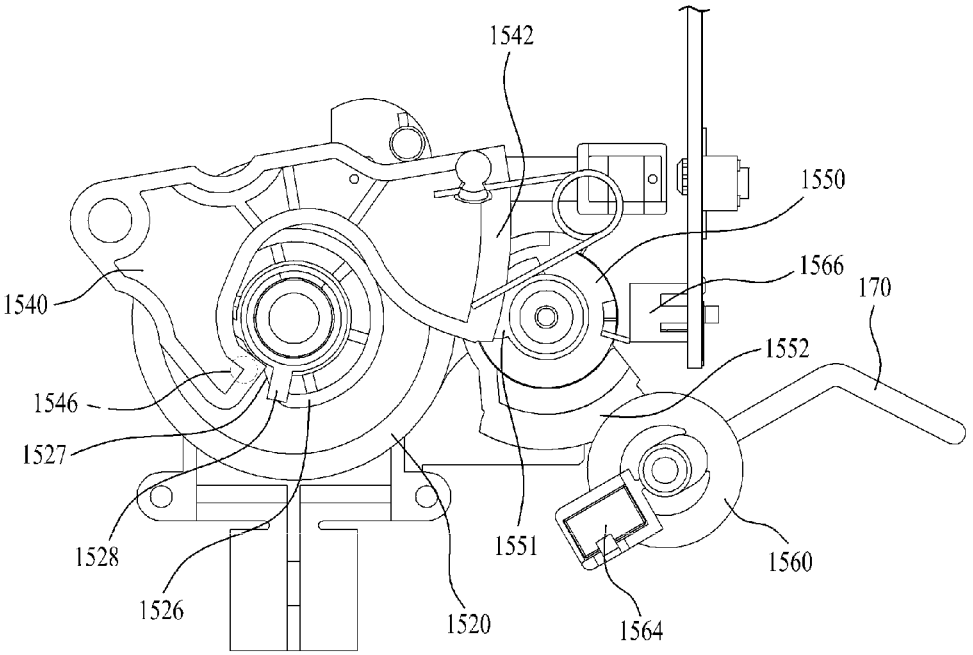

Next, FIGS. 10(*a*) and 10(*b*) illustrates example turning of the ice-fullness sensing bar 170 according to turning of the second turning member 1540 and sensing of the turning by the second Hall sensor 1566.

FIG. 10(*a*) illustrates the second turning member 1540 turned downward according to pushing of the second projection 1546 by the outer circumferential surface of the second cam 1526 with the ejector 120 remaining at the first position. In this state, the stoppage projection 1528 has entered the side surface of one end of the second turning member. Accordingly, when the groove 1527 reaches the position of the stoppage projection 1528, downward turning of the second turning member 1540 is blocked by the stoppage projection 1528.

In this state, the arc-shaped large gear part 1542 formed at the other end of the second turning member 1540 has turned the turning force transmitting gear 1550 counterclockwise, and thereby the ice-fullness sensing bar turning gear 1560 has turned clockwise, lowering the ice-fullness sensing bar 170 to the lower position. At this time, the magnet 1564 positioned opposite to the ice-fullness sensing bar 170 approaches the second Hall sensor 1566, thereby generating a sensing signal in the second Hall sensor 1566.

FIG. 10(*b*) illustrates the ejector 120 turned to the second position. In this state, the stoppage projection 1528 appears by turning, and at the same time, the second cam 1526 reaches the position where the second projection 1546 is disposed. Accordingly, when the second projection 1546 is moved into the groove 1527 of the second cam 1526 by the elastic force from the second elastic member 1554, the second turning member 1540 turns upward.

At this time, the arc-shaped large gear part 1542 formed at the other end of the second turning member 1540 turns the turning force transmitting gear 1550 clockwise. Thereby, the ice-fullness sensing bar turning gear 1560 turns counterclockwise, raising the ice-fullness sensing bar 170 to the upper position. At this time, the magnet 1564 positioned opposite to the ice-fullness sensing bar 170 moves away from the second Hall sensor 1566, and thus sensing of signals by the second Hall sensor 1566 is interrupted.

As described above, sensing fullness of ice is performed as the ice-fullness sensing bar 170 moves from the position of FIG. 10(*a*) to the position of FIG. 10(*b*) and then back to the position of FIG. 10(*a*).

When the ejector 120 rotates in the forward direction to separate ice, the ejector rotating gear 1520 shown in FIG. 10 rotates clockwise. At this time, the second turning member 1540 does not turn since the stoppage projection 1528 is stopped by one end of the second turning member 1540. Accordingly, the ice-fullness sensing bar 170 also remain lowered as shown in FIG. 10(*a*).

When the icemaker 100 is operated for the first time, the angular position of the ejector is checked using the first Hall sensor unit. Thereby, the ejector 120 is disposed to the initial position.

Next, a predetermined amount of water is supplied to the ice tray 110, and the water is left for the time for which ice is formed by the supplied cold air. At this time, temperature of the ice tray 110 may be measured through the temperature sensor 182 to determine whether the water has completely changed into ice.

Next, by rotating the ice-fullness sensing bar 170, whether the ice bank 200 provided below the icemaker 100 is full of ice is determined. When it is determined that the ice bank is full of ice, ice fullness is periodically sensed and separation of ice is not performed until it is determined that the ice bank is no longer full of ice.

Next, when it is determined that the ice bank 200 is not full of ice, the heater 140 is controlled to generate heat. The heater 140 generates heat for a predetermined time prior to start of rotation of the ejector. The operation of generating heat may be continuously performed, or may be intermittently performed with a predetermined period. In addition, pulse heating with a very short period may be performed.

When a predetermined time elapses after heat is generated by the heater 140, or the temperature of the ice tray 110 measured with the temperature sensor is greater than or equal to a predetermined temperature, the ejector is rotated in the forward direction to separate the ice from the ice tray 110.

At this time, the heater 140 continues generating heat after the ejector 120 starts to rotate, and is turned off before the ejector 120 returns to the initial position. That is, the first Hall sensor 1536 senses the time at which the protrusion fins 124 of the ejector 120 reach the second position, and turns off the heater 140 at that time.

Once the ice is substantially rotated about three hundred degrees according to rotation of the ejector 120 for separation of ice, the heater does not need to be operated any more since the ice has already been separated.

In addition, in the step of separation of ice, the ejector 120 may complete two rotations rather than one rotation. In the case that the ejector 120 is designed to complete one rotation, ice may not be completely separated. Accordingly, by rotating the ejector 120 twice, complete separation of the ice may be ensured. In addition, separated ice may be stuck between the protrusion fins 124 of the ejector 120. Rotating the ejector 120 twice may help ensure that the separated ice drops into the ice bank 200.

As apparent from the above description, the present invention has effects as follows.

An icemaker as described throughout may be convenient to use and may be highly durable. In addition, it may be designed to have a compact size to allow efficient use of space.

In addition, an icemaker as described throughout may have a high reliability in use and may consume low energy.

It will be apparent to those skilled in the art that various modifications and variations can be made without departing from the spirit or scope of the disclosure. Thus, it is intended that the present disclosure covers the modifications and variations provided they come within the scope of the appended claims and their equivalents.

What is claimed is:

1. An icemaker comprising:

an ice tray that is provided in a freezer, that is configured to receive water, and that is configured to retain the received water such that the received water is frozen into ice by cold air in the freezer;

an ejector configured to rotate to eject the ice from the ice tray;

a heater arranged to contact the ice tray and that is configured to facilitate separation of the ice from the ice tray by selectively heating the ice tray;

a case mounted to a side of the ice tray;

a brushless direct current (BLDC) motor that is mounted in the case and that is configured to selectively rotate the ejector in forward and reverse directions;

a dropper inclined from an upper end of a front of the ice tray toward an upper portion of a rotating shaft of the ejector; and an overflow prevention member horizontally oriented below the dropper and configured to face a rotating shaft of the ejector, the overflow prevention member including a plurality of slits that are configured to allow protrusion fins of the ejector to pass through the plurality of slits.

2. The icemaker according to claim 1, further comprising a guide member configured to guide the cold air supplied from the freezer to the ice tray such that cold air flow surrounds the ice tray.

3. The icemaker according to claim 2, wherein the guide member is configured to guide the cold air such that a portion of the cold air supplied to an upper portion of the ice tray flows to a rear side of a rear wall of the ice tray, thereby flowing through a space between a lower surface of the ice tray and the guide member.

4. The icemaker according to claim 3, wherein the guide member comprises:

an upper air guide mounted over the ice tray and that is configured to guide the cold air supplied to the ice tray such that the cold air is supplied to the rear side of the ice tray; and a lower air guide that surrounds a lower portion of the ice tray and that is spaced a predetermined distance from the ice tray.

5. The icemaker according to claim 1, further comprising an overflow prevention wall extending upward from a rear end of the ice tray.

6. The icemaker according to claim 1, wherein the motor is configured to rotate a rotating shaft of the ejector by a predetermined angle in forward and reverse directions.

7. The icemaker according to claim 1, further comprising:

an ice bank arranged below the ice tray and that is configured to store ice ejected from the ice tray; and a sensing bar configured to sense whether ice stored in the ice bank has reached a predetermined level.

8. The icemaker according to claim 1, further comprising a temperature sensor unit arranged between a case of the driving unit and a sidewall of the ice tray.

9. The icemaker according to claim 8, wherein the temperature sensor unit comprises:

a sealing plate formed of a metallic material and attached to an inner side surface of the case of the driving unit; and a temperature sensor arranged inside the case and configured to measure a temperature of the sealing plate by contacting the sealing plate.

10. An icemaker comprising:

an ice tray that is provided in a freezer, that is configured to receive water, and that is configured to retain the received water such that the received water is frozen into ice by cold air supplied from the freezer;

an ejector configured to rotate to eject the ice from the ice tray;

a heater arranged to contact the ice tray and that is configured to facilitate separation of the ice from the ice tray by selectively heating the ice tray;

a case mounted to a side of the ice tray;

a brushless direct current (BLDC) motor that is mounted in the case and that is configured to selectively rotate the ejector in forward and reverse directions; and a driving unit configured to turn the ejector selectively, wherein the driving unit comprises a first sensor unit configured to sense the angular position of the ejector, the first sensor unit comprising:

a first cam provided to a first side surface of a gear axially coupled to a rotating shaft of the ejector, the first cam including two grooves formed at predetermined angular positions on an outer circumferential surface of the first cam;

a first turning member configured to turn based on a first projection located at a side portion of the first turning member contacting and sliding along the outer circumferential surface and the two grooves of the first cam;

a first magnet provided to an end of the first turning member;

a first Hall sensor configured to sense a voltage signal generated based on the first magnet being located within a threshold distance of the first Hall sensor; and a first elastic member configured to pull the first turning member such that the first projection of the first turning member contacts the first cam.

11. The icemaker according to claim 10, further comprising:

an ice bank arranged below the ice tray and that is configured to store ice ejected from the ice tray; and a sensing bar configured to be turned by the driving unit and sense whether ice stored in the ice bank has reached a predetermined level, wherein the driving unit further comprises a second sensor unit configured to sense an angular position of the sensing bar.

12. The icemaker according to claim 11, wherein the second sensor unit comprises:

a second cam provided to a second side surface of the gear axially coupled to the rotating shaft of the ejector, the second cam having a groove formed at a predetermined angular position on an outer circumferential surface of the second cam;

a second turning member configured to turn based on a side portion of the second turning member contacting and sliding along the outer circumferential surface and the groove of the second cam;

a sensing bar turning gear configured to be selectively turned by an arc-shaped large gear located at an end of the second turning member and axially coupled to a turning shaft of the sensing bar;

a second magnet provided to a side of the sensing bar turning gear;

a second Hall sensor configured to sense a voltage signal generated based on the second magnet being located within a threshold distance of the second Hall sensor; and a second elastic member configured to pull the second turning member such that a side portion of the second turning member contacts the second cam.

13. The icemaker according to claim 12, wherein the second Hall sensor unit further comprises a turning force transmitting gear arranged between the arc-shaped large gear of the second turning member and the sensing bar turning gear, the turning force transmitting gear increasing a gear ratio.

14. The icemaker according to claim 13, wherein the turning force transmitting gear comprises:

an arc-shaped small part adapted to turn based on engagement with the arc-shaped large gear;

an arc-shaped large part adapted to turn based on engagement with the sensing bar turning gear; and a third elastic member arranged between and connected to the arc-shaped small part and the arc-shaped large part to allow the arc-shaped large part to turn with respect to the arc-shaped small part.

15. The icemaker according to claim 12, wherein the sensing bar is configured to selectively turn based on the motor rotating the ejector by a predetermined angle in forward and reverse directions.

16. The icemaker according to claim 15, wherein the sensing bar is configured to sense whether ice stored in the ice bank has reached the predetermined level by turning from a lower position to an upper position and then back to the lower position based on the motor rotating the ejector by a predetermined angle in the reverse direction and then in the forward direction, the lower position being an initial position.

17. The icemaker according to claim 12, further comprising a circuit board arranged in the case of the driving unit, configured to input a power on/off signal to the motor, and provided with the first Hall sensor and the second Hall sensor, the circuit board being configured to receive a temperature signal from a temperature sensor arranged inside the case and deliver the temperature signal to a main controller, and being configured to deliver a command signal from the main controller to the motor.

* * * * *